US007344112B2

(12) United States Patent
Nice

(10) Patent No.: US 7,344,112 B2
(45) Date of Patent: Mar. 18, 2008

(54) APPARATUS FOR TRANSFERRING LIQUID FROM A CONTAINER

(76) Inventor: Kirk B. Nice, 599 Cam Fella Blvd., Stouffville, Ontario (CA) L4A 7H3

( * ) Notice: Subject to any disclaimer, the term of this patent is extended or adjusted under 35 U.S.C. 154(b) by 4 days.

(21) Appl. No.: 11/302,856

(22) Filed: Dec. 13, 2005

(65) Prior Publication Data

US 2006/0124807 A1 Jun. 15, 2006

(30) Foreign Application Priority Data

Dec. 13, 2004 (CA) ..... 2489976

(51) Int. Cl.
*A47F 5/00* (2006.01)

(52) U.S. Cl. ..... 248/125.1; 248/125.8

(58) Field of Classification Search ..... 248/125.1, 248/125.3, 125.7, 125.8, 125.9, 129, 130, 248/131, 146, 141, 121, 508
See application file for complete search history.

(56) References Cited

U.S. PATENT DOCUMENTS 711,339 A * 10/1902 Park ..... 248/141
2,554,875 A * 5/1951 Okunami ..... 248/141
4,278,223 A * 7/1981 Fauteux ..... 248/125.8
5,316,248 A * 5/1994 Allen ..... 248/129
5,374,019 A * 12/1994 Fischer ..... 248/125.7
5,890,686 A * 4/1999 Morales ..... 248/141
6,019,484 A * 2/2000 Seyler ..... 362/287
6,224,026 B1 * 5/2001 Dubois ..... 248/118.3
2002/0043595 A1 * 4/2002 Bridgers ..... 248/125.8
2002/0056794 A1 * 5/2002 Ibrahim ..... 248/177.1

* cited by examiner

*Primary Examiner*—Ramon O Ramirez
(74) *Attorney, Agent, or Firm*—Conley Rose, P.C.

(57) ABSTRACT

An apparatus for facilitating the transferring of liquid from a container comprises a base, a height adjustable stem extending upwardly from the base to a stem upper end portion, a carrying frame defining a carrying space therewithin, the carrying space sized and shaped to hold a liquid container, such as a standard 25 L gas container. The carrying frame is pivotally mounted to the stem upper end portion, pivotal about a pivot axis from an upright position to a tilted dispensing position. In the tilted position, the container is positioned such that the contents of the container may be dispensed. The base may comprise a plurality of equidistantly spaced arms, extending perpendicularly from the stem and remotely from a central portion of the base with at least one said arm including a vertically oriented screw hole extending therethrough, adapted to accept a screw member for securing the base to a supporting surface below the base. Alternately or additionally, the base may include a bottom surface with roller means mounted thereto to facilitate rolling of the apparatus relative to a supporting surface.

18 Claims, 13 Drawing Sheets

APPARATUS FOR TRANSFERRING LIQUID FROM A CONTAINER

CROSS-REFERENCE TO RELATED APPLICATIONS

This application claims priority to Canadian Application No. 2,489,976 filed Dec. 13, 2004.

STATEMENT REGARDING FEDERALLY SPONSORED RESEARCH OR DEVELOPMENT

Not Applicable.

FIELD OF THE INVENTION

This invention relates to an apparatus utilized to assist in the transferring of liquid from a container.

BACKGROUND OF THE INVENTION

Motorized vehicles such as motor boats, all terrain vehicles, go-carts, mopeds, snowmobiles, and outdoor equipment such as lawn mowers, weeders, trimmers, and snow blowers often utilize small gasoline powered engines to operate and therefor require gasoline to be delivered thereto. To do so, gasoline is typically delivered to the machine in a portable gas container. A well known example of a gasoline container is a 25 liter capacity container shown in the drawings having approximate dimensions of 11-12 inches in height H; 11-12 inches in depth D; and 4-6 inches in width (not shown). A handle 100 and pouring opening 102 are typically positioned on the top of the container. The pouring opening often includes a dispensing tube 104 with a dispensing valve 106 attached to the container to selectively effect dispensing of gasoline. To dispense liquid from a container, unless a pump is utilized, the pouring opening must be positioned below the liquid line within the container and the container must be positioned above the intended location of delivery of the liquid. Since the pouring opening 102 in most known liquid containers is located at the top thereof, the container must be tilted to bring the liquid to the pouring opening. Carrying and holding the containers in the necessary elevated tilted position for transferring of liquid (such as gasoline) is often quite cumbersome for the user and commonly results in unwanted spillage and back strain.

It is also known to use similar sized and shaped containers for storing and pouring other types of liquid, such as water or the like and the transferring of liquid from such containers is also quite cumbersome.

There is a need for an apparatus which is assists with the transferring of liquid, such as gasoline, oil or water from a container in an improved manner.

SUMMARY OF THE INVENTION

It is an object of the invention to provide an improved apparatus for transferring liquid, such as gasoline from a container.

In accordance with an aspect of the invention, there is provided an apparatus for facilitating the transferring of liquid from a container comprising: a base, a height adjustable stem, extending upwardly from the base to a stem upper end portion; a carrying frame defining a carrying space therewithin. The carrying space is sized and shaped to hold a liquid container and said carrying frame is pivotally mounted to the stem upper end portion, pivotal about a pivot axis from an upright position to a tilted dispensing position. In the tilted position, the container is positioned such that the contents of the container may be dispensed from a dispensing opening of the container. In the upright position, the container is oriented in an upright position.

In accordance with a further aspect of the invention, the stem may comprise a lower tubular stem member extending upwardly from the base and an upper tubular stem member, with one said stem member slidably engaged within the other said stem member and selectively releasably positionable in a plurality of relative vertical positions. The upper stem member may be swiveled about the vertical axis relative to the lower stem member which allows for altering the position of the container around the stem, without requiring movement of the base of the apparatus itself.

In accordance with a further aspect of the invention, the base may comprise a plurality of equidistantly spaced arms, extending perpendicularly from the stem and remotely from a central portion of the base with at least one said arm including a vertically oriented screw hole extending therethrough, adapted to accept a screw member for securing the base to a supporting surface below the base. Alternately or additionally, the base may include a bottom surface with roller means mounted thereto to facilitate rolling of the apparatus relative to a supporting surface positioned therebelow.

Other objects, features and advantages of the present invention will be apparent from the following non-restrictive description of example embodiments of the invention, made with reference to the accompanying drawings.

BRIEF DESCRIPTION OF THE DRAWINGS

Similar reference numerals are used to denote similar components throughout the drawings.

DESCRIPTION OF EXAMPLE EMBODIMENTS OF THE INVENTION

Figure 6:
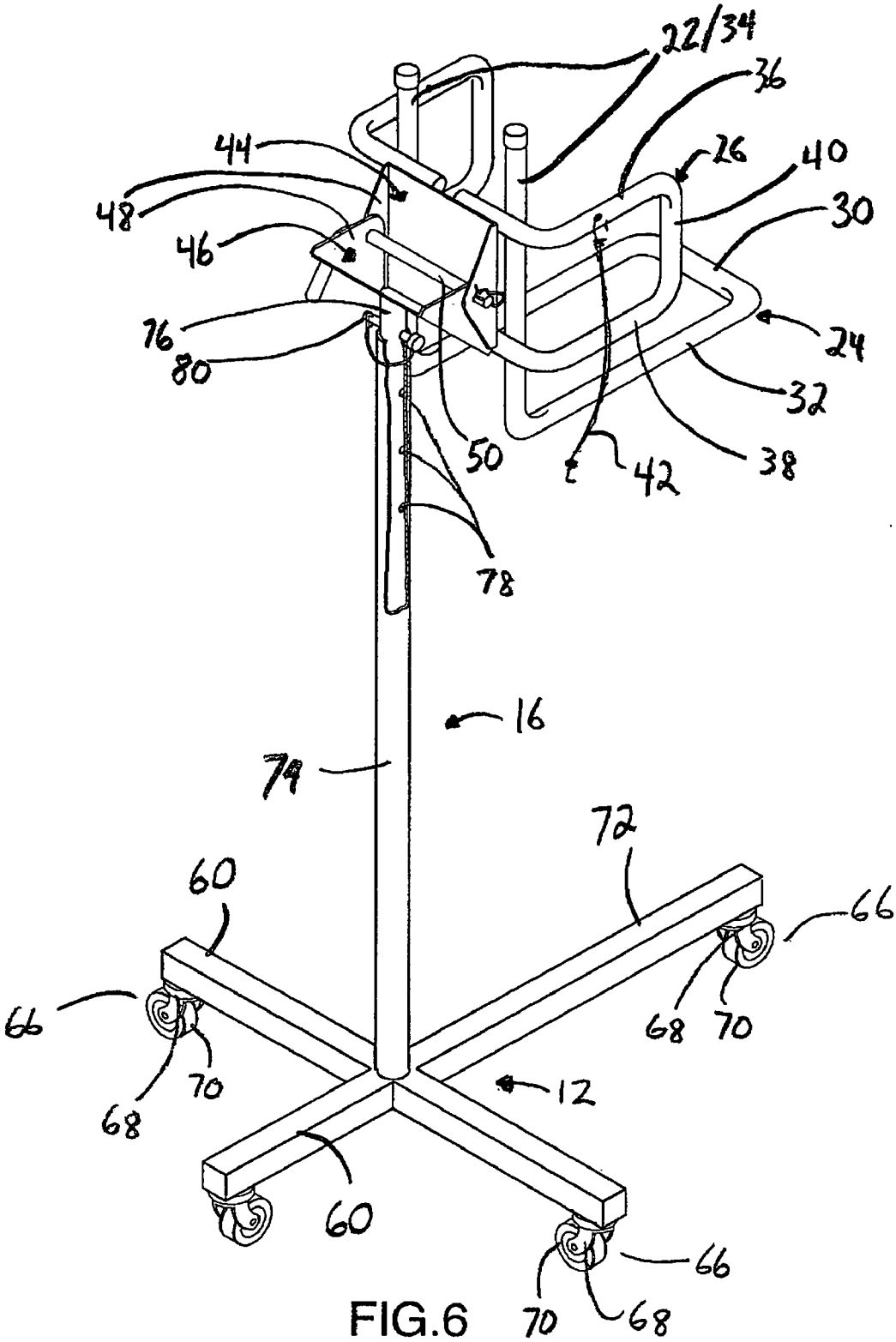
FIG. 6 is perspective view of a second example embodiment of the apparatus in accordance with the invention.
Figure 7:
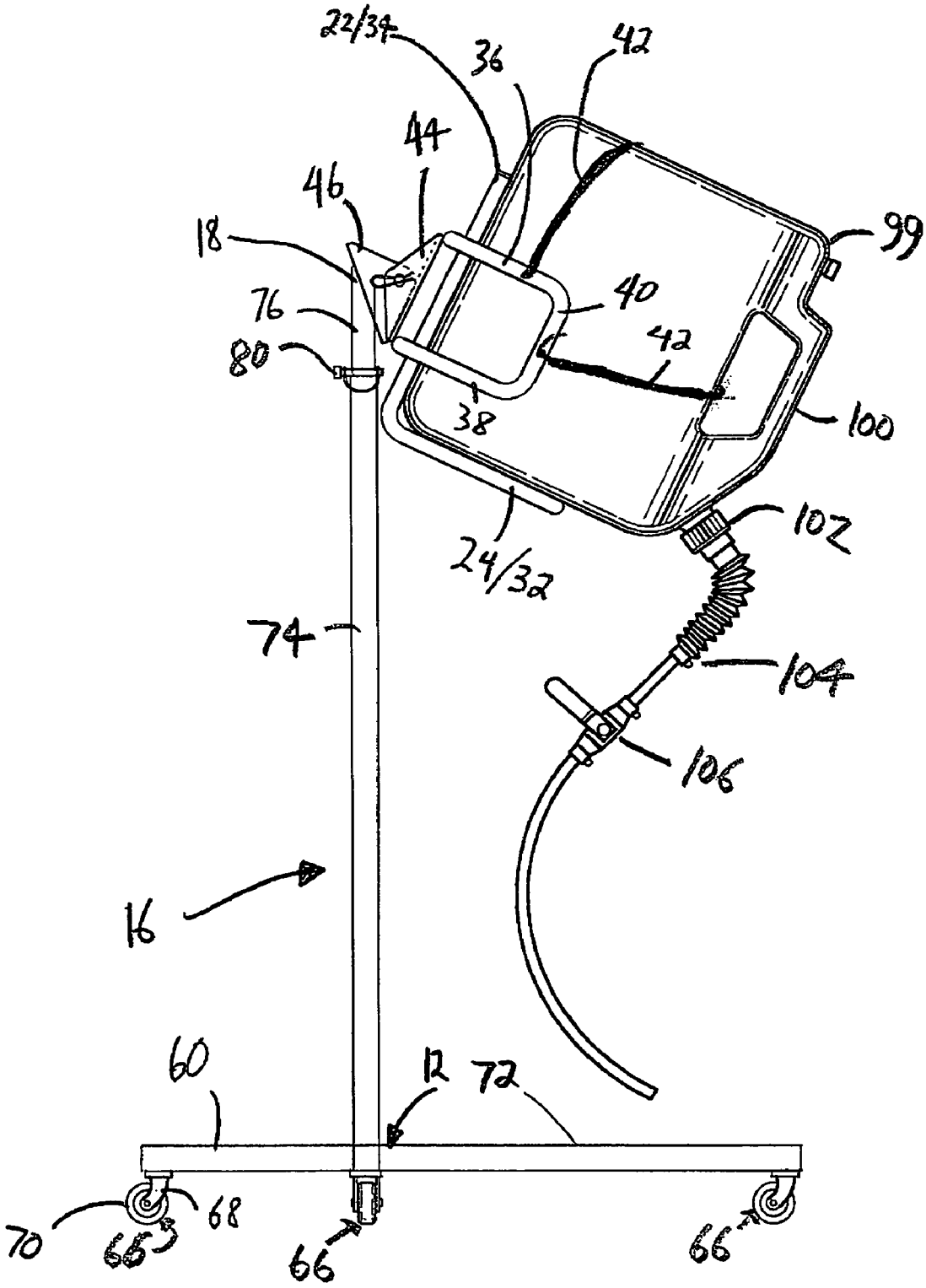
FIG. 7 is a side elevation view of the example embodiment of FIG. 6 in a tilted position with container positioned in the carrying frame.
Figure 8:
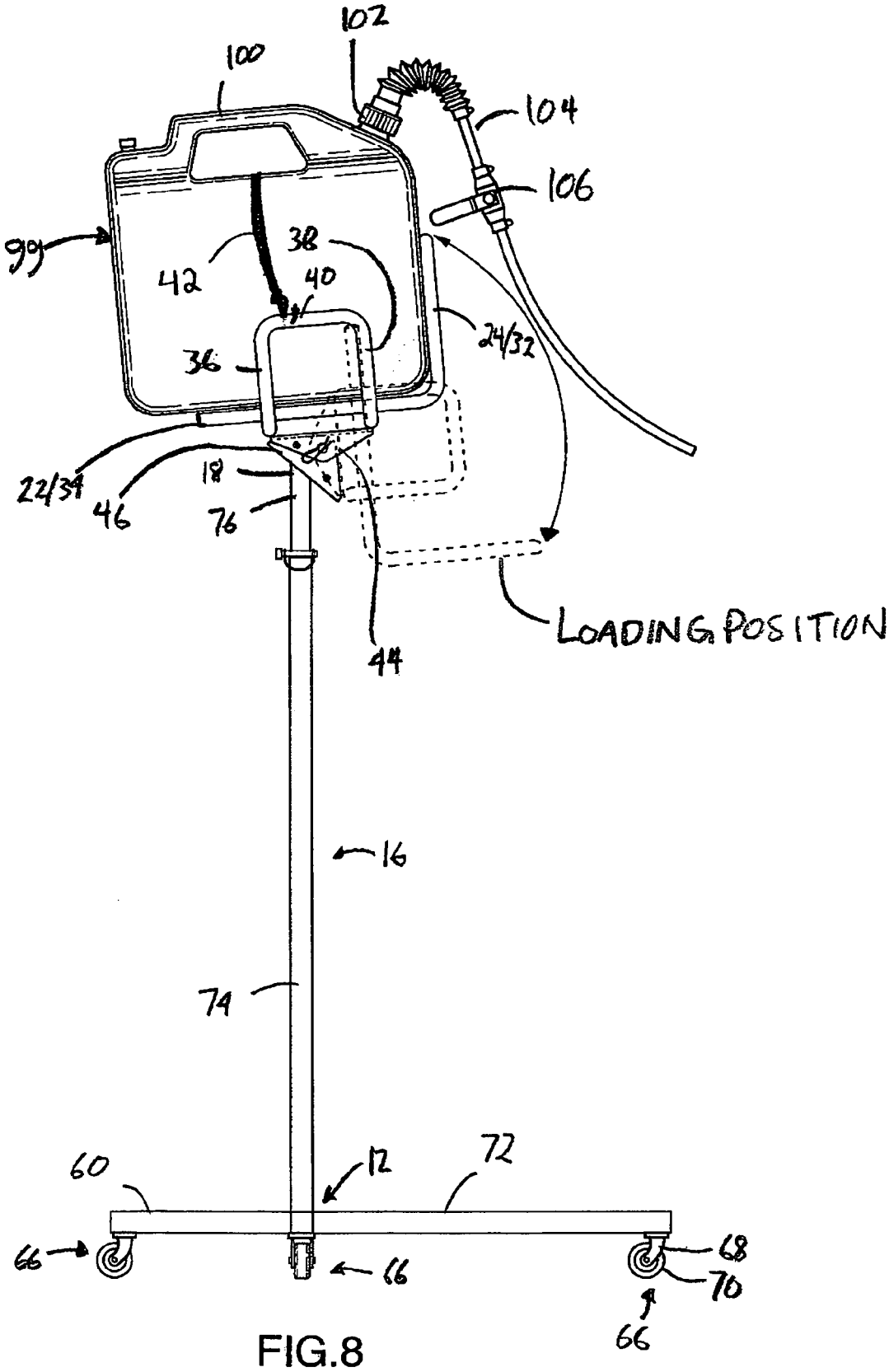
FIG. 8 is a side elevation view corresponding to that of FIG. 7 in an upright position with a loading position shown in dotted lines.

Two example embodiments of the apparatus for transferring liquid from a container are illustrated in the Figures and are described below. A first embodiment is shown in FIGS. 1 to 5 and a second embodiment is shown in FIGS. 6 to 8. The apparatus 10 of the invention includes a base 12 adapted for stable engagement with a supporting surface 14, such as a dock or the floor of a work space. A height adjustable stem 16, extends upwardly from the base to a stem upper end 18. A carrying frame 20 defines a carrying space therewithin and is sized to hold a liquid container, such as for example container 99. The carrying frame is pivotally mounted to the stem upper end portion 18, pivotal between an upright position, shown in FIGS. 3 and 8 and a tilted position, shown in FIGS. 1 and 2 and 4 to 7.

The embodiments of the apparatus described herein are adapted to carry a liquid container such as the well known standard gasoline container 99 having approximate dimensions described above as 11-12" in height H, 11-12" depth D, and 6-10" (116.8 mm) width (not shown). A handle 100 and spout opening 102 may be positioned on the top of the container 99. The pouring opening often includes a dispensing tube, such as tube 104 with a dispensing valve 106 attached to the container to selectively effect dispensing of liquid. Although, the apparatus is shown in the Figures being adapted to hold container 99, it should be understood, that the apparatus may include a carrying frame sized to hold containers of various shapes and sizes as desired. In fact, although not illustrated, it should be understood that the frame members may be extendable or retractable in length to accommodate containers of different sizes.

The carrying frame of the apparatus comprises a bottom member 24, rear side member 22, two spaced apart lateral side members 26 and an open front side. In the upright position, the container 99 rests on the rear side member 22. From the upright position, the frame may be pivoted about a pivot axis (P) to the tilted position (shown in dotted lines in FIG. 3). Preferably the upright position and tilted positions are separated angularly at least 90° about pivot axis P. It should be understood that the angular separation and orientation of the tilted and upright positions relative to the horizontal and vertical planes may be varied as desired. As can be seen in the drawings, the titled position is angled below a horizontal line, however, in alternate embodiments, it may be positioned at or above the horizontal. In the tilted positions shown in the drawings, the container is carried by the bottom side member 24. In this example, the container is further restrained by a strap 42 attached to lateral side members of the carrying frame. It should be understood that if additional restraining means is desired, the container may be restrained by any suitable strap or clip or the like.

The example embodiments shown in the figures include a rear member 22 and bottom member 24 that are integrally formed together. The bottom member 24 is u shaped and comprises a central front portion 30 with parallel spaced apart legs 32 extending rearwardly therefrom. The legs 32 then extend perpendicularly upwardly to form rear member legs 34. Each lateral side member 26 is also u shaped having parallel upper 36 and lower portions 38 extending rearwardly from a forward portion 40, said upper and lower portions extending across the rear member legs 34, being mounted thereto, preferably by welding or mechanical fastening. The rear member 22, lateral side members 26 and the bottom member 24 not only provide support for the container, but also provide some protection against inadvertent unwanted impacts to the container. In the embodiments shown, the frame members 22, 24, 26 are formed of steel tubing, with a ¾ inch diameter. The preferred dimensions of the frame are as follows: The lateral side member forward portion 40 has a length of 6½ inches; the lateral side member upper 36 and lower 38 portions are 7 inches in length; the bottom member front portion 30 has a length of 6½ inches; bottom member spaced apart legs 32 are 10 inches in length; the rear member legs 34 are 14 inches in height; and the distance between lateral side member is 9¾ inches. To best accommodate and support the example container 99, the distance between lateral side members 26 should be at least 8 inches, the length of rear member legs 34 should be at least 10 inches, and the length of the bottom member legs 32 should be at least 12 inches. Although, as mentioned above, the size and shape of the carrying frame may be altered to suite various sized containers as desired. If desired, additional means to secure the container within the carrying space may be provided, such as for example by means of a fastening cord 42. An example may be a strap or a rubber bungie cord 42 with "s" hooks on either end, positioned across the top and/or side of the container, secured to the lateral side members (as seen in FIGS. 6, 7 and 8) through holes therein. As mentioned above, if desired the container may be restrained by any suitable restraining means such as a clip or strap or the like.

Figure 5:
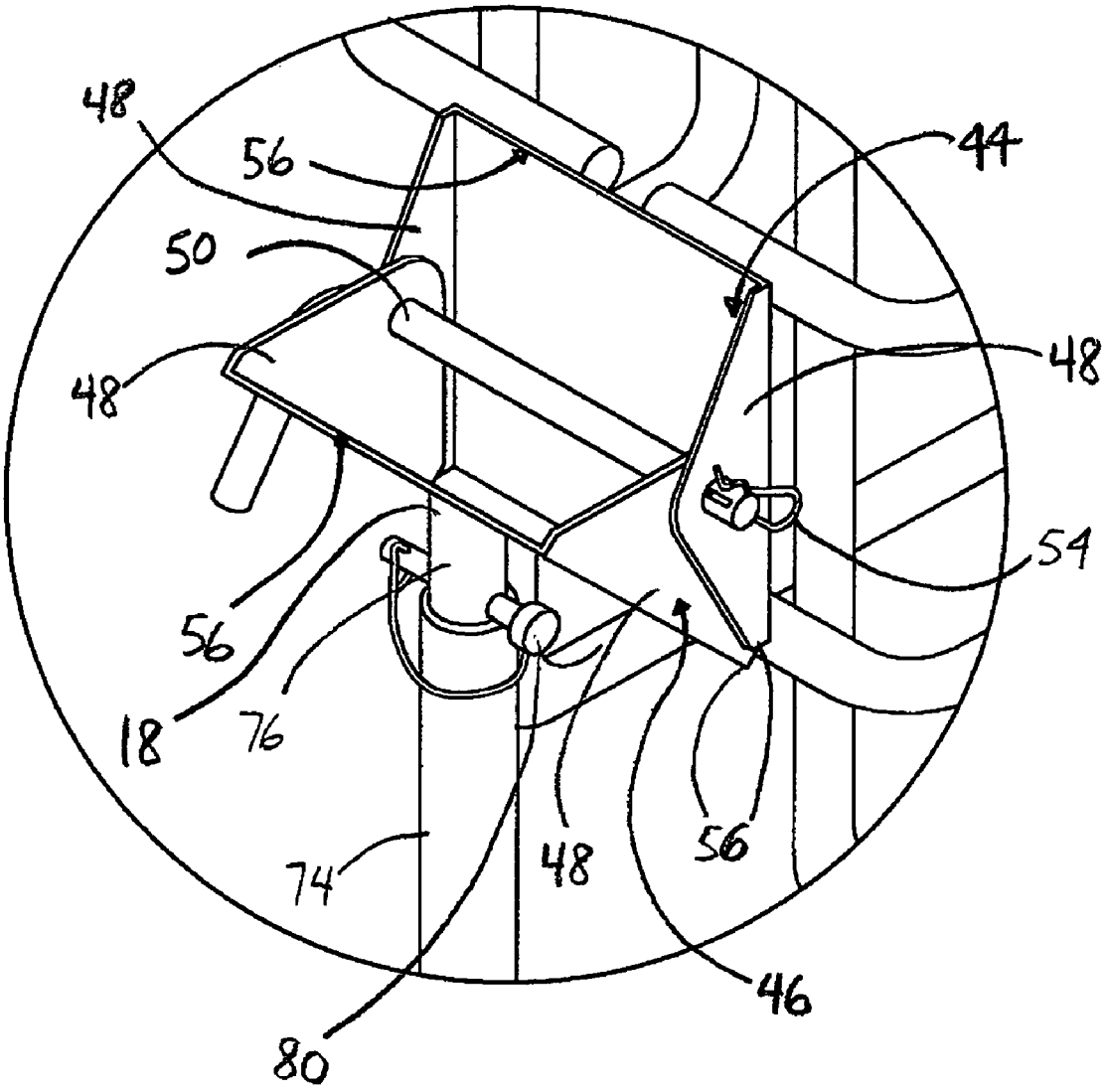
FIG. 5 is an enlarged view of the portion of FIG. 1, illustrated by chain dotted circle 4 in FIG. 2.

In the embodiment best illustrated in FIG. 5, the carrying frame 20 is pivotally attached to the upper end portion 18 of the stem 16 by a first pivot plate 44 mounted to the rear/bottom of the carrying frame 20 and a second plate 46 mounted to the upper end of the stem 18. Pivot plates 44, 46 have aligned/nesting side walls 48 and are pivotally attached together by means of a pivot bar 50 extending through mating holes 52 defined in the aligned/nested side walls 48. The pivot bar 50 may be secured therein by means of a cross fastening pin 54 extending through an end of the pivot bar 50. The mating holes 52 are preferably positioned at the apex of the mating nesting side walls 48. The plates 44, 46 pivot about the pivot bar 50 causing pivoting of the frame from the upright position to the tilted position. The plates are shaped such that mating opposed remote portions 56 of the plates engage each other when the frame is in the upright position and the tilted position respectively, thereby limiting the range of pivoting of the frame. In certain embodiments, the frame engages the stem in the dispensing position, thereby preventing further tilting beyond the dispensing position.

Figure 5A:
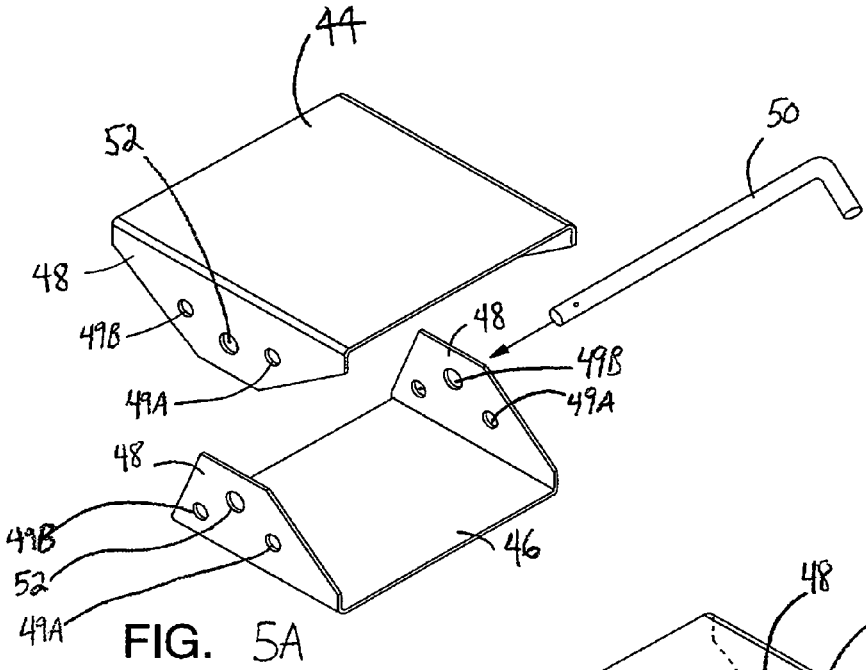
FIG. 5A, is an exploded perspective view of an alternate embodiment of pivot plates in accordance with an aspect of the invention.
Figure 5B:
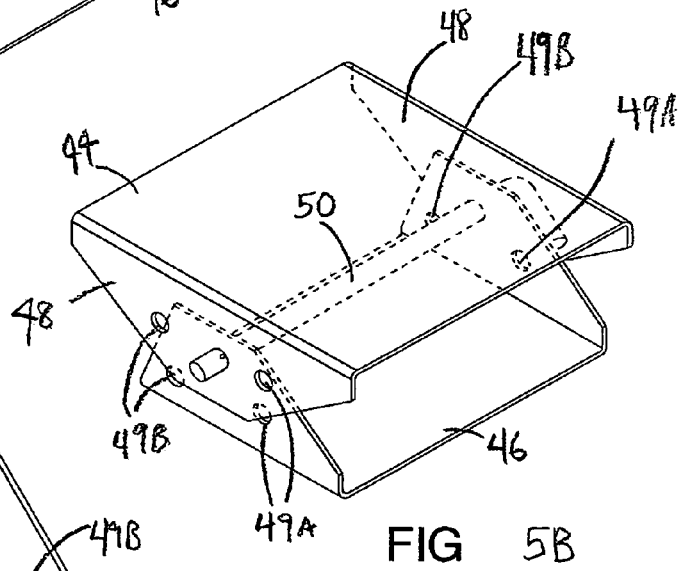
FIG. 5B is a perspective view of the embodiment of pivot plates shown in FIG. 5A.
Figure 5C:
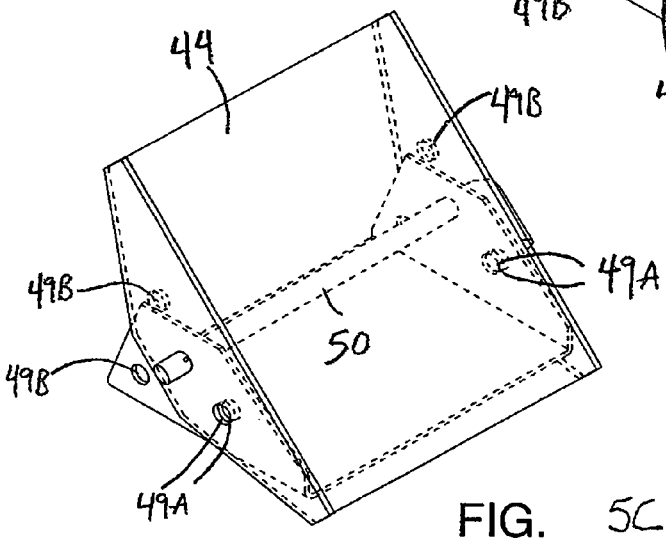
FIG. 5C is a further perspective view of the embodiment of pivot plates shown in FIG. 5A in a titled position.

A further embodiment of pivot plates 44, 46 is shown in FIGS. 5A, 5B, 5C. In this embodiment pivot plates 44, 46 have side walls 48 which are pivotally attached together in a similar manner to the embodiment of FIG. 5, namely with plates 44, 46 pivoting about the pivot bar 50 which extends through centrally located aligned holes 52 in side walls 48. In this embodiment, each side wall also includes locking holes 49A, 49B. Locking Holes 49A, 49B are positioned such that the locking hole 49A in the upper and lower plates align when upper plate is tilted in a first direction relative to lower plate (as can be seen in FIG. 5C) and locking hole 49B in each plate align when titled in the opposite direction. This allows plates 44, 46 to be selectively locked in such titled positions by inserting a locking rod through the aligned locking holes 49A or 49B when in the desired titled position. It should be understood that locking holes may be positioned at various locations on the side walls of the plates and in varying numbers to allow for selection of various degrees of tilt between the pivot plates. For example, as discussed below, the locking holes may be utilized to position the carrying frame in intermediate positions such as a loading position (shown in FIG. 8).

Figure 4A:
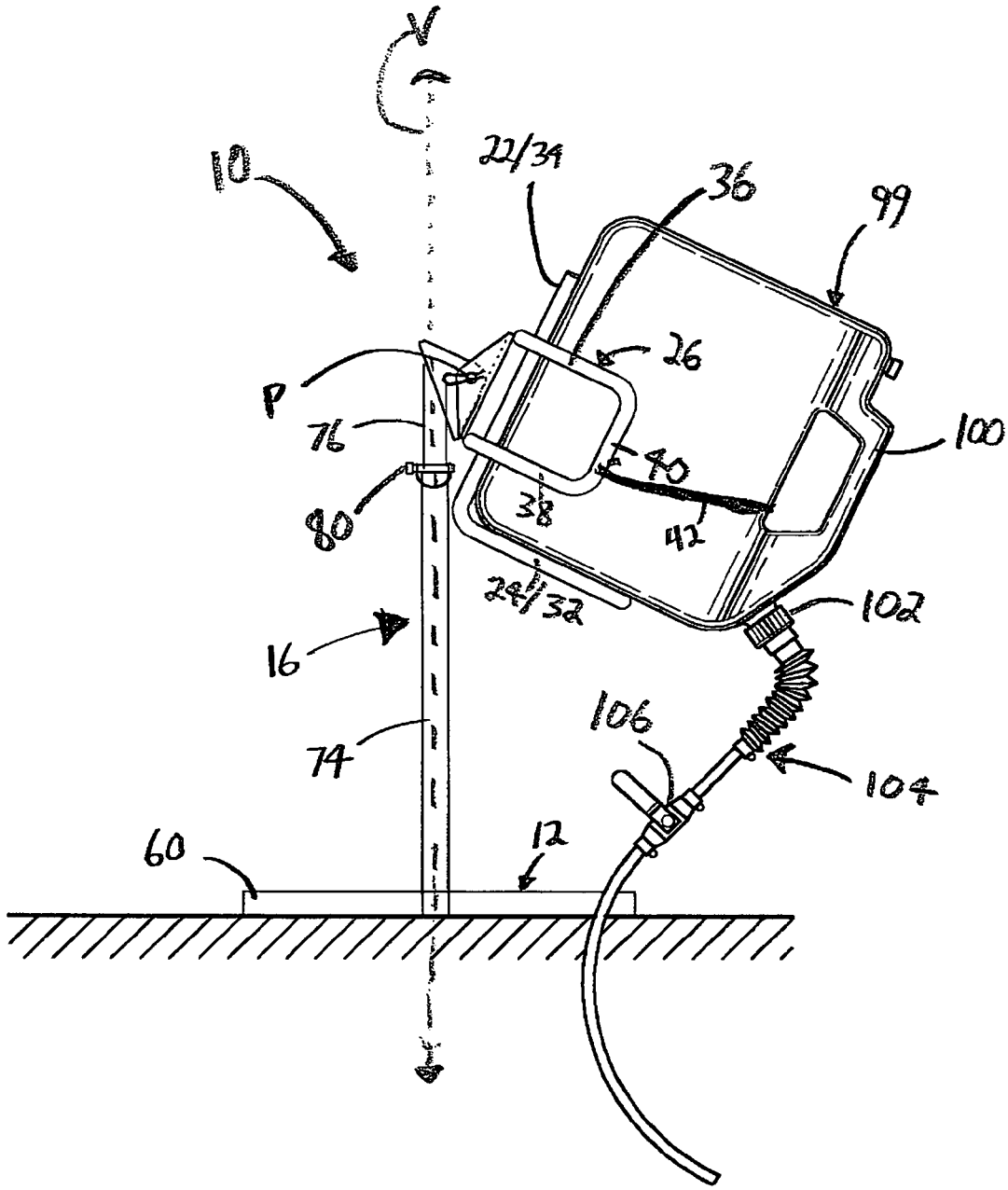
FIG. 4*a* is a side elevation view corresponding to that of FIG. 3 in a pouring position.
Figure 4B:
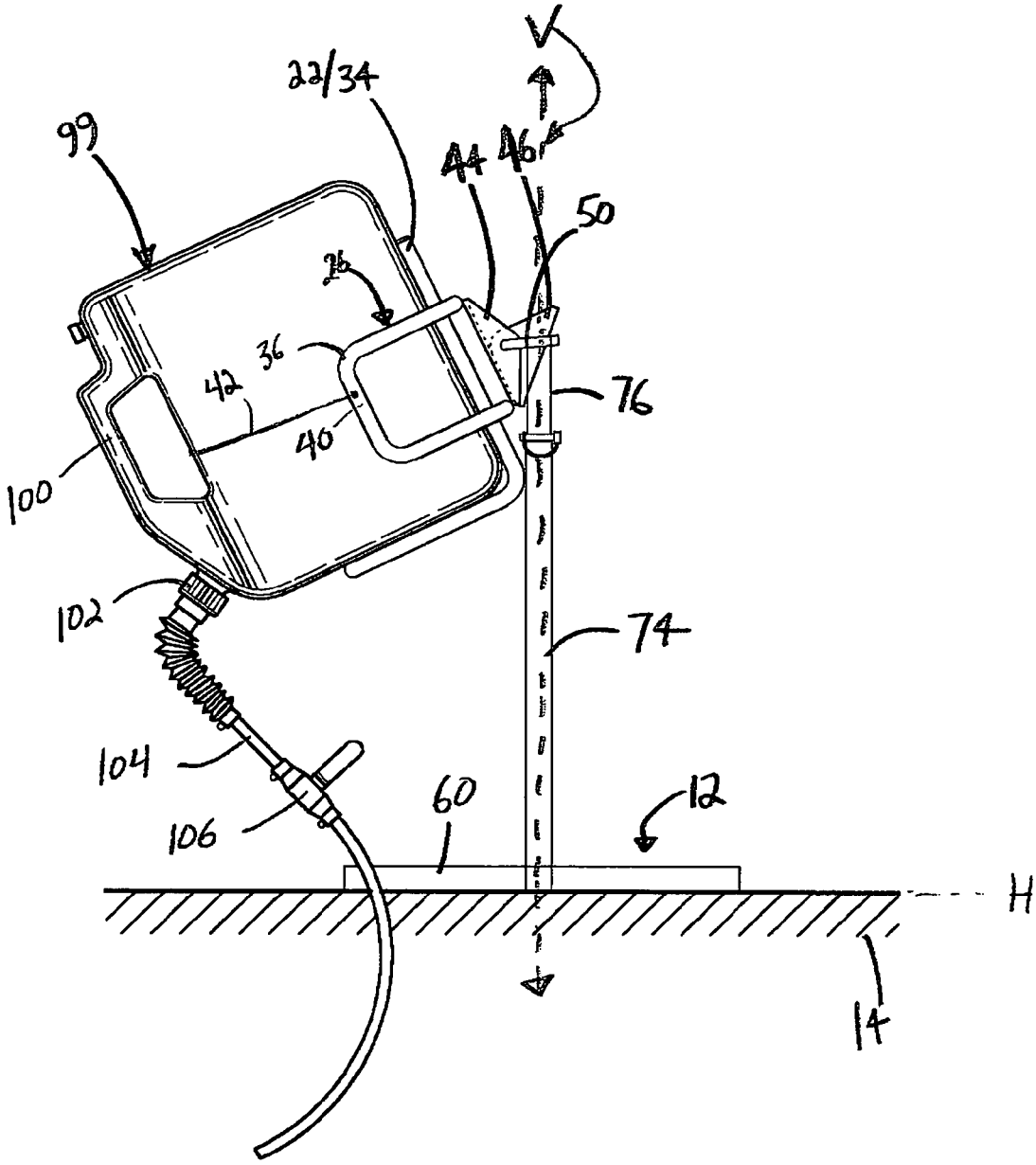
FIG. 4*b* is a reverse side elevation view corresponding to FIG. 4*a*, showing the carrying frame rotated 180 degrees from the position illustrated in FIG. 4*a;*

As can be seen FIGS. 4*a*, 4*b* and 7, in the tilted position, the container is now positioned such that the container opening 102 is positioned at or near the bottom of the container 99, to ensure that liquid within the container will exit the container opening 102. In the example embodiments shown, in the titled position, the container is titled below the horizontal plane, to ensure that all liquid can be emptied from the container. It should be understood that the angle of tilt of the upright and tilted position may be varied as desired.

In the embodiment of FIGS. 1 to 5, the base 12 includes a central portion 58 and a peripheral portion extending perpendicularly to the stem remotely from the central portion. The stem 16 extends upwardly from the central portion 58 of the base. The peripheral portion comprises a plurality, and preferably 4 equidistantly spaced arms 60, extending peripherally from said central portion 58. In this embodiment at least one arm includes a vertically oriented screw hole (or pin hole) 62, extending therethrough which is adapted to accept a screw member 64 for securing the base to a supporting surface 14, such as a marine dock. Preferably the screw hole (or pin hole) has a 3/16 inch diameter. This feature is particularly useful when the apparatus utilized in a marine environment and in particular on a dock for filing a boat engine with gasoline. Because this embodiment of the apparatus is able to be secured to the supporting surface, such as a dock, it prevents the apparatus from being inadvertently tipped over into the water.

In the embodiment of the invention shown in FIGS. 6 to 8 the base includes a bottom surface 63 with roller means mounted thereto to facilitate rolling of the apparatus relative to the supporting surface. In the example shown, the roller means comprises a caster 66 positioned at a peripheral end of each arm 60, 72. Preferably each caster 66 includes a caster frame 68 swivel mounted to the base and a 2 inch diameter wheel 70. In order to enhance the stability of the apparatus, in the embodiment shown in FIG. 6 to 8, an elongated stabilizing arm 72 of the base 12 is positioned under said carrying frame 20 when in the tilted position. The stabilizing arm 72 is substantially longer than the other arms 60 of the base. In the embodiment shown, the stabilizing arm 72 has a length of approximately 20.25 inches with the other arms 60 being approximately 10.25 inches in length.

In the example embodiments of the apparatus shown in the figures, the components of the carrying frame and stem are comprised of steel tubing, the frame having a diameter of 3/4 inch and the parts of the stem 16 having diameters of 1 1/4 to 1 1/8$^{th}$ inch, as will be discussed further below. The mounting plates are also comprised of steel. The arms of the base are formed of 1.25 inch cross sectioned steel pieces. It should be understood that any sufficiently strong and rigid material, such as high density plastic or wood may be utilized other than steel.

Figure 1:
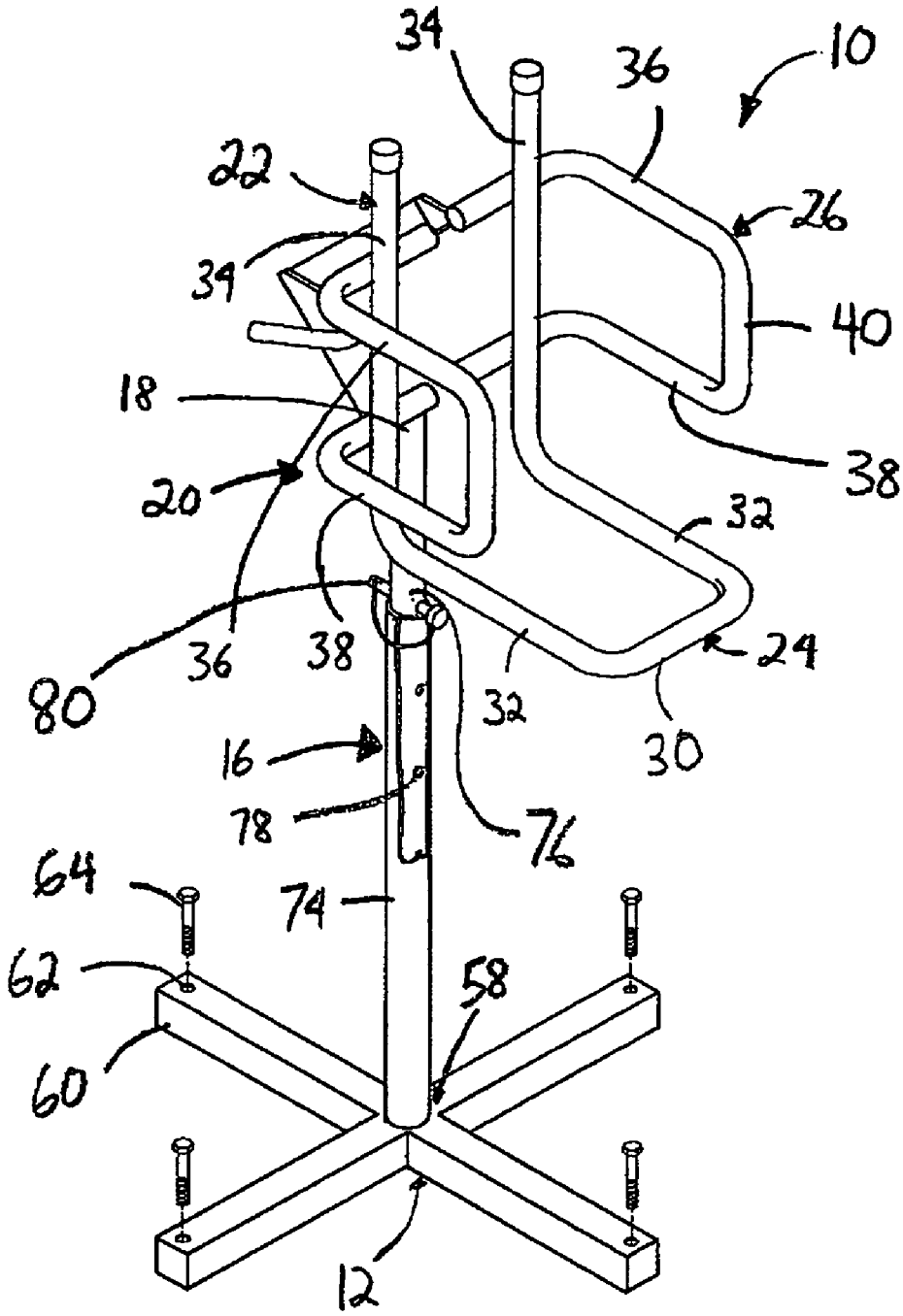
FIG. 1 is perspective view of an example embodiment of the apparatus in accordance with the invention, in a tilted position, with a portion of the stem cut away to illustrate pin holes.
Figure 2:
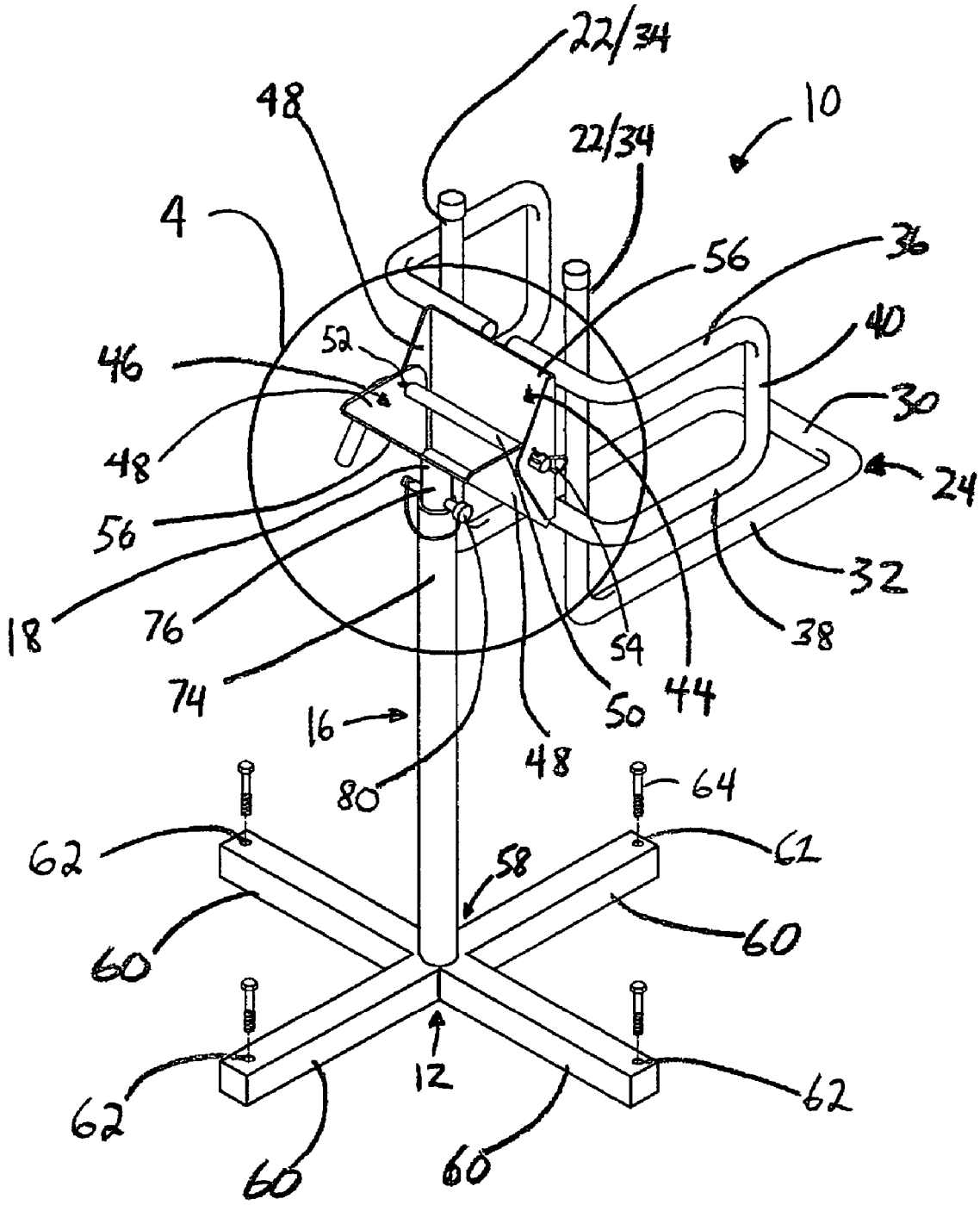
FIG. 2 is a rear perspective view of the example embodiment of FIG. 1.
Figure 3:
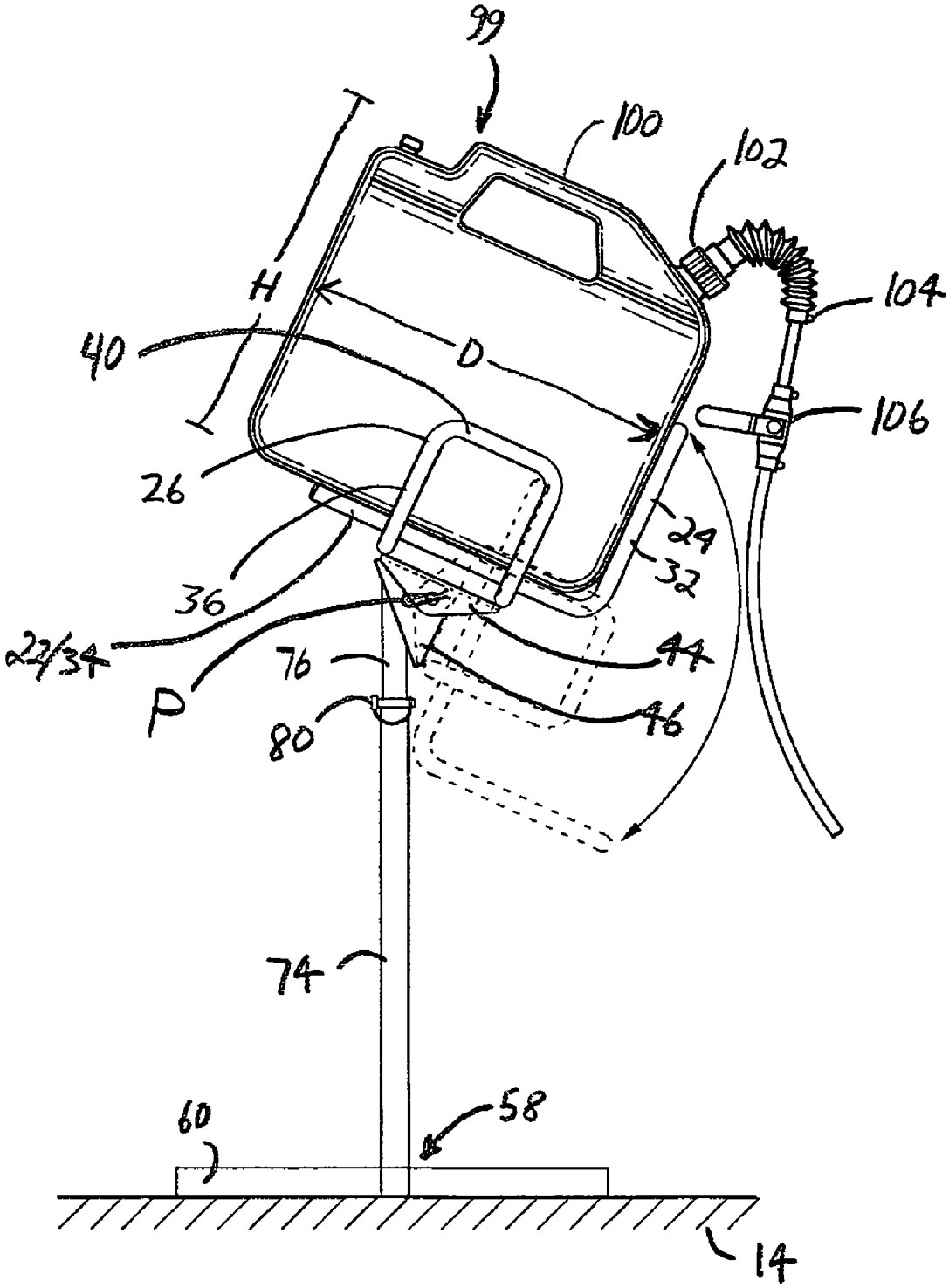
FIG. 3 is a side elevation view of the example embodiment of FIG. 1 in an upright position.

In the example embodiments shown in the Figures, the height adjustable stem comprises a lower tubular stem member 74 extending upwardly from the base and an upper tubular stem member 76 slidably engaged within the lower tubular stem member. The lower tubular stem member 74 has a diameter of 1 1/4 inch and the upper tubular stem member 76 has a diameter of slightly less, such as 1 1/8 inch, to facilitate insertion thereof in the lower member for sliding engagement therewith. The upper tubular stem member forms a plurality of vertically aligned spaced apart pin holes 78 positioned such that a pin hole may be selectively aligned above the upper edge of the lower tubular stem portion 74 and a pin 80 may be selectively inserted in the holes 78 with a portion of said pin when so inserted resting on the upper edge of the lower stem member 74, thereby positioning the stem 16 selectively in one said adjustable vertical position. As best seen in FIGS. 1 and 6 (which illustrate the lower stem member with a portion thereof cut out) the upper member includes 4 such pin holes, being 3/8 inch diameter each, extending along the length thereof. It should be understood that any number of pin holes may be provided in any desired size and spacing. It should also be understood that although not shown, the lower tubular stem could be slidably engaged within the upper tubular stem member in a similar but opposite arrangement of holes and tube dimensions if so desired.

In the embodiment of FIGS. 1 to 5 and best seen in FIGS. 4A and 4B, the upper stem member 76 may be swiveled about the vertical axis V relative to the lower stem member 74 when said pin 80 is inserted with said pin hole 78 and resting on the lower stem member 74. FIGS. 4A and 4B shown the carrying frame in positions oriented 180 degrees from each other. This feature is especially desirable in the embodiment shown in FIGS. 1 to 5 which may be secured to the ground surface and utilized in a marine dock setting for example, which would allow dispensing from various positions around the apparatus, such as from both sides of an elongated dock extending into the water. In this embodiment the upper stem member may be swiveled 360 degrees relative to the lower stem member. Although not illustrated, it should be understood that the upper and lower tubular stem members may be releasably secured in a plurality of relative vertical positions by other known securing means than that illustrated in the drawings. In the example embodiment of FIGS. 6 to 8, to ensure stability of the apparatus, the height adjustment pin 80 extends through mating holes in both the upper 76 and lower 78 stem, thereby preventing the swivelling of the upper stem relative to the lower stem. This ensures that the carriage frame stays positioned over the stabilizing arm 72. Because the carriage frame stays positioned over the stabilizing arm, the likelihood of the apparatus toppling over is diminished significantly relative to positioning the carriage frame over the other arms of the base, which is especially important as this embodiment is not secured to the ground surface.

Figure 8A:
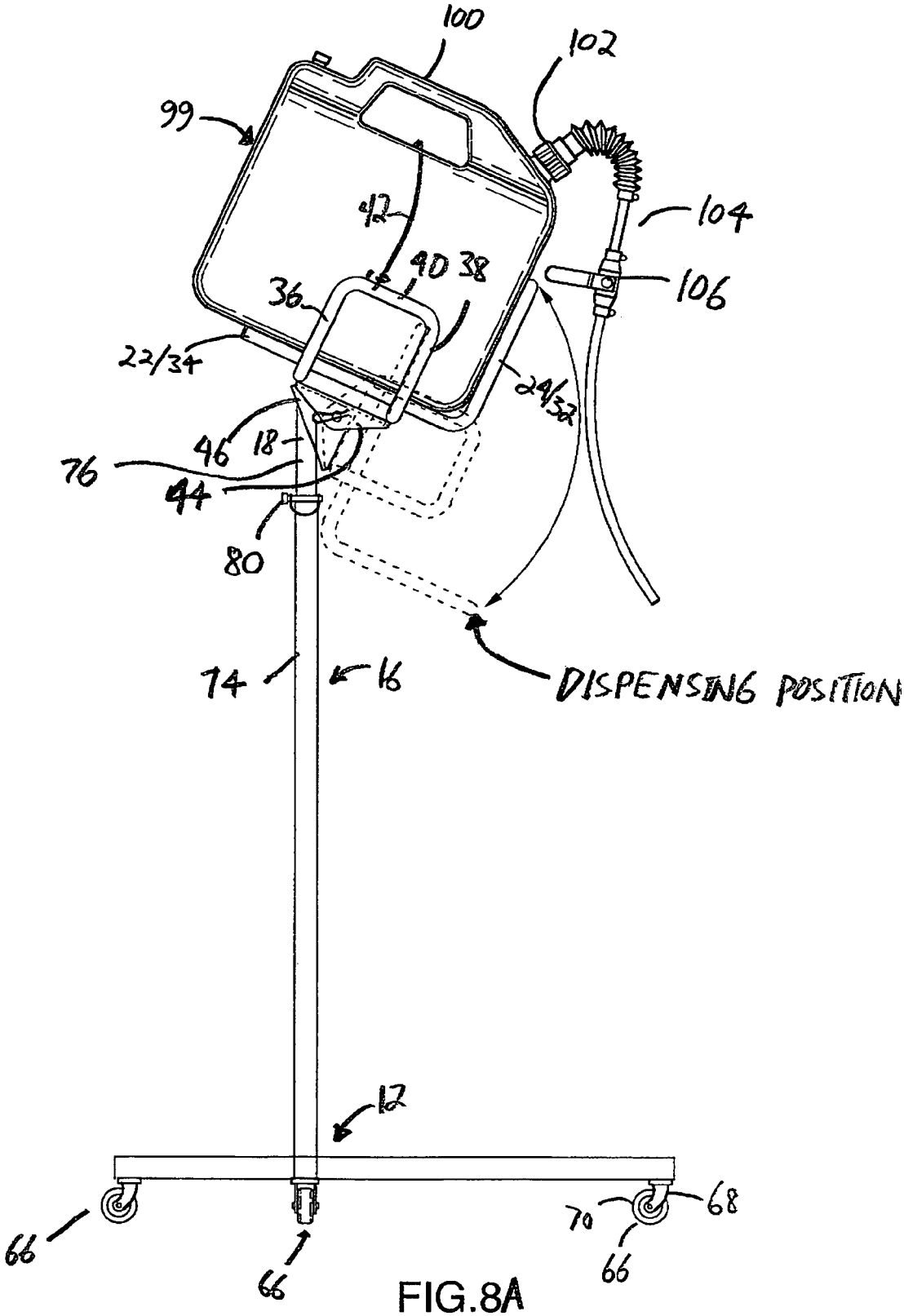
FIG. 8A is a side elevation view corresponding to that of FIG. 8 in a further upright position, with a dispensing position in dotted lines.

In the embodiment of FIG. 8, the container may be loaded into the carrying frame when the frame is in the position indicated by dotted lines (indicated as the Loading Position in FIG. 8). Loading in this position, as opposed to the upright position would be particularly advantageous in embodiments of the apparatus where the carrying frame is elevated from the ground a substantial distance (such as at shoulder height, i.e. 4 feet or more). The carrying frame may be locked in the loading position by using the pivot plates shown in FIGS. 5A to 5C as follows: Such plates 44, 46 could be aligned such that when locking holes 49A in each pivot plate align and a locking pin is inserted therein, the carrying frame would be positioned in the loading position of FIG. 8. Similarly, the carrying frame could be locked in an upright position by using the pivot plates of FIGS. 5A to 5C such that holes 49B align when the plates are in the desired upright position. From the loading position of FIG. 8, the carrying frame would be further tiltable to the dispensing position of FIG. 8A by removing the locking pin from aligned holes 49A. In the dispensing position, a portion of the carrying frame would engage the stem so as to prevent further titling. Alternately the dispensing position could be set by forming the pivot plates such that they are prevented from tilting below a preset angle, the desired dispensing position. As discussed above, the specific angle of tilt of the loading position may be varied as desired by adjusting the position of the locking holes. Likewise, the specific angle of the dispensing and upright positions may also be varied as desired, by adjusting the shape and orientation of the pivot plates, frame, and the locking holes.

Figure 9A:
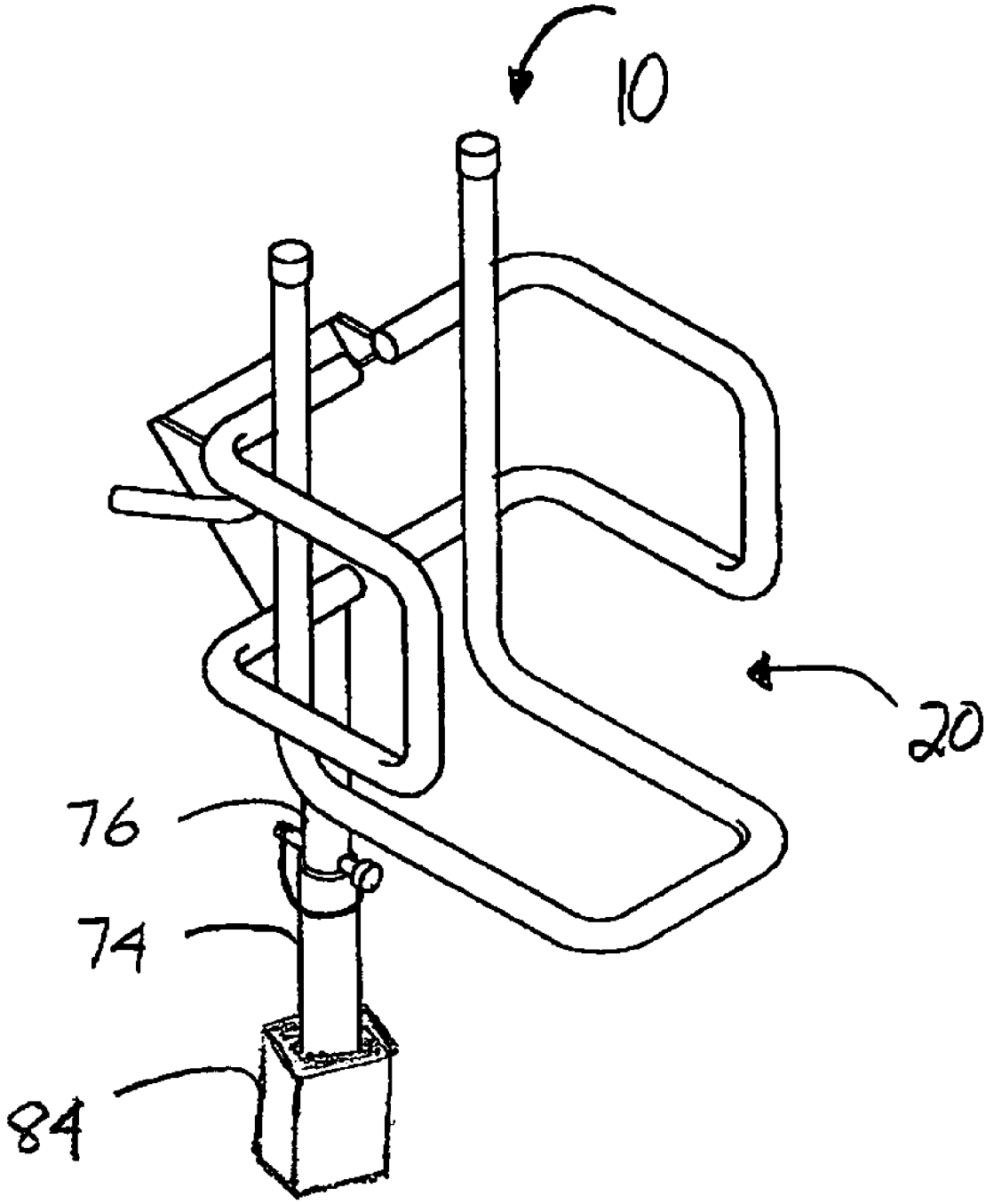
FIGS. 9A and 9B are perspective view and side elevational views, respectively, of a further embodiment of the invention having a base adapted to be attached to a truck box.
Figure 9B:
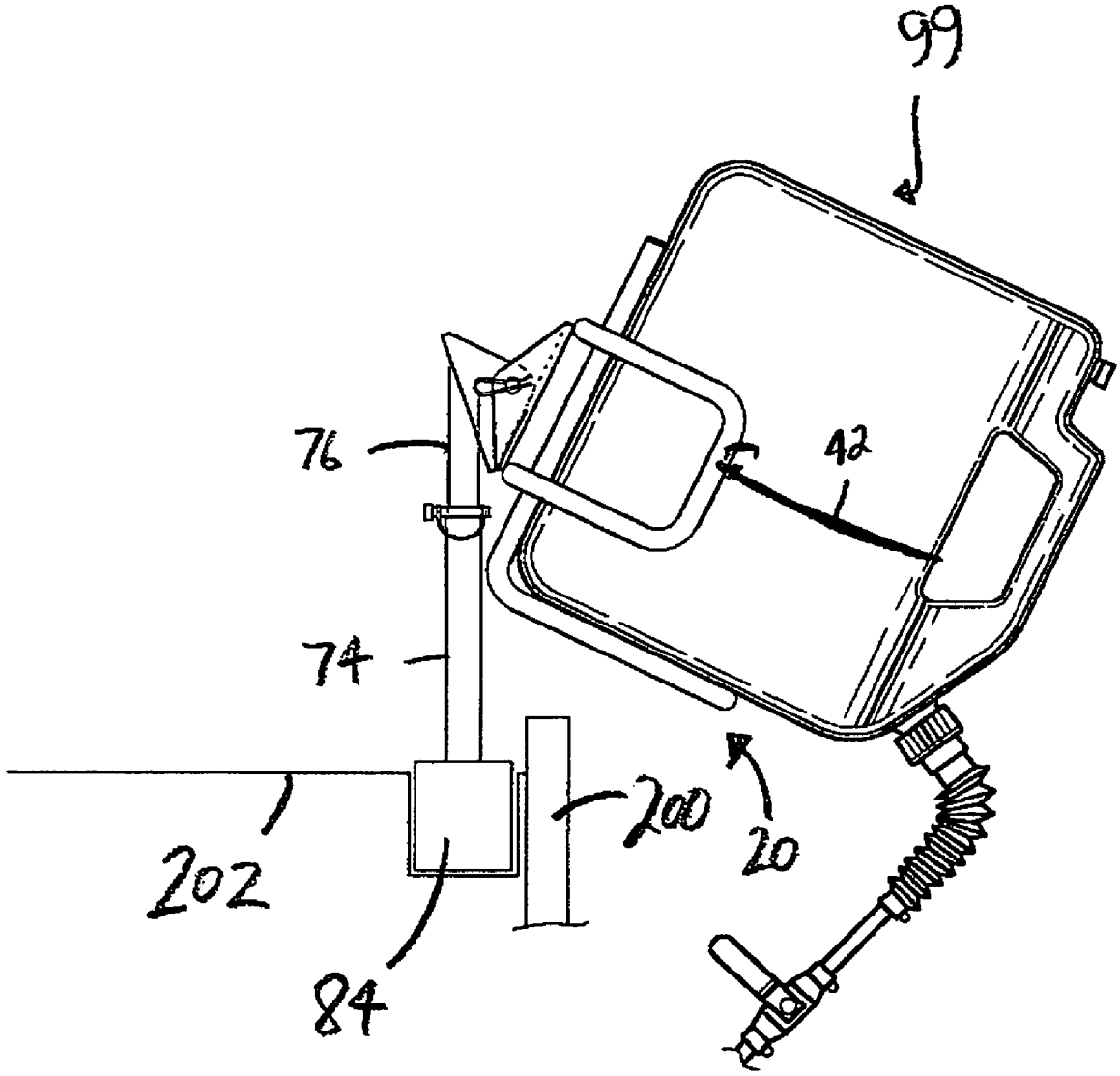

In a further embodiment of the invention, shown in FIGS. 9A and 9B, the embodiment of FIGS. 1 to 5 is adapted such that it may be secured within a standard vertical square hole typically located within the truck bed of a pick up truck. In the embodiment of FIGS. 9A and 9B, the base comprises a rectangularly shaped block 84, welded to the lower stem 74. The block 84 is preferably sized to be inserted within the peripherally located side holes located on the floor 202 of a truck box, positioned adjacent the truck bed walls 200, and thus the apparatus may be releasably secured within the truck box, with the carrying frame 20 positionable over the side of the truck to allow dispensing of fluid to a position adjacent the truck, without removing the apparatus from the truck. Preferably the block is welded to lower stem member 74 and has dimensions to match the standard truck box side holes, namely having a width of 2⅜ inches, depth of 1⅞ inches and a height of at least 3 inches. It should be understood that these dimensions may vary as desired to accommodate insertion within various sized truck box (or other type of) openings. This embodiment is particularly useful to refuel vehicles and equipment which is typically transported on the back of a pick up truck, such as motocross motorcycles, ATVs, lawnmowers, weeders, trimmers or the like. It should be further understood that if desired the apparatus may be attached to the back of a truck in any other known manner.

The above-described embodiments of the present invention are intended to be examples only. Alterations, modifications and variations may be effected to the particular embodiments by those skilled in the art without departing from the scope of the invention, which is defined by the claims appended hereto.

I claim:

1. An apparatus for storing and facilitating the pouring of liquid from a container comprising:

a base;

a height adjustable stem, extending upwardly from the base to a stem upper end portion;

a carrying frame defining a carrying space therewithin, the carrying space sized and shaped to hold a liquid container, said carrying frame pivotally mounted to the stem upper end portion, pivotal about a pivot axis from an upright position to a tilted dispensing position;

wherein said base comprises a plurality of equidistantly spaced arms, extending perpendicularly to the stem and remotely from a central portion of the base; and wherein at least one said arm includes a vertically oriented screw hole extending therethrough, said screw hole being adapted to accept a screw member for securing said base to a supporting surface positioned below the base.

2. An apparatus as recited in claim 1 wherein said stem comprises a lower tubular stem member extending upwardly from the base and an upper tubular stem member extending upwardly from the lower tubular stem member, with one said stem member slidably engaged within the other said stem member and selectively releasably positionable in a plurality of relative vertical positions.

3. An apparatus as recited in claim 2 wherein said upper tubular stem member forms a plurality of vertically aligned spaced apart pin holes such that the pin holes may be selectively aligned above the lower tubular stem portion and a pin may be selectively inserted in the holes with a portion of said pin when so inserted resting on the lower stem member, thereby positioning the stem selectively in one said adjustable vertical position.

4. An apparatus as recited in claim 3 wherein said stem defines a vertical axis and said upper stem member may be swiveled about the vertical axis relative to the lower stem member when said pin is inserted with said pin hole and resting on the lower stem member.

5. An apparatus as recited in claim 1 wherein said base comprises 4 equidistantly spaced arms.

6. An apparatus as recited in claim 1 wherein one said arm is positioned directly under said carrying frame when positioned in said tilted position, and that one said arm is substantially longer than the other said arms of the base.

7. An apparatus as recited in claim 1 wherein said carrying frame and stem are formed of steel tubing.

8. An apparatus as recited in claim 1 wherein the carrying frame is adapted to carry a liquid container having a pouring opening at an upper end thereof.

9. An apparatus as recited in claim 1 wherein the carrying frame is adapted to carry a liquid container having a height of 11 to 12 inches, a depth of 11 to 12 inches and a width of 6 to 10 inches, said container having a container opening at an upper end thereof.

10. An apparatus for storing and facilitating the pouring of liquid from a container comprising:

a base;

a height adjustable stem, extending upwardly from the base to a stem upper end portion;

a carrying frame defining a carrying space therewithin, the carrying space sized and shaped to hold a liquid container, said carrying frame pivotally mounted to the stem upper end portion, pivotal about a pivot axis from an upright position to a tilted dispensing position; and wherein said carrying frame comprises a bottom member, rear side member, two spaced apart lateral side members and an open front side, said frame members defining the carrying space therein, the container resting on the rear side member when in the upright position and the carrying frame being pivotal about the pivot axis to the tilted position, such that the container is carried by the bottom member when the frame is in said tilted position.

11. An apparatus as recited in claim 10 wherein said carriage frame is pivotally attached to the upper end portion of the stem by a first pivot plate mounted to the rear of the carriage frame and a second pivot plate mounted to the upper end of the stem, each pivot plate having a pair of side walls, the pair of side walls of the first pivot plate in nesting engagement with the pair of side walls of the second pivot plate, the plates being pivotally attached together by a pivot bar extending through mating holes defined in the nested side walls, the plates pivoting about the pivot bar between said upright position and said tilted position, with opposing mating remote portions of the plates engaging each other when the frame is in the upright position and the tilted position, respectively, so as to limit the extent of movement of the plates.

12. An apparatus as recited in claim 10 wherein said carriage frame is pivotally attached to the upper end portion of the stem by a first pivot plate mounted to the rear of the carriage frame and a second pivot plate mounted to the upper end of the stem, the pivot plates each having a pair of opposed side walls, each side wall having a pivot hole defined therein, the side walls of the upper plate and lower plate positionable adjacent each other in nesting relation, such that the pivot holes in the side walls of the upper and lower plates align to allow a pivot bar to extend through said aligned pivot holes to pivotally attach the plates together, the plates pivoting about the pivot bar between said upright position and said tilted position, each side wall including first and second locking holes, the first locking holes of the plates aligning when the plates are in the upright position, and the second locking holes aligning when the plates are in the titled position.

13. An apparatus as recited in claim 10, wherein when positioned in the tilted position liquid may be dispensed from the container and the rear member extends from the pivot axis below a horizontal plane, so as to ensure that liquid may be emptied from the container.

14. An apparatus as recited in claim 13 wherein said container is secured in the carrying frame by means of a strap extending across the container and attached to carrying frame at opposite lateral side members thereof.

15. An apparatus as recited in claim 10 wherein said bottom member and rear member are integrally formed together with the bottom member being u shaped comprising a central front portion with parallel spaced apart legs extending rearwardly therefrom, and said rear member comprising rear member legs which extend upwardly from each spaced apart leg of the bottom member, the lateral side members each being u shaped having upper and lower portions extending rearwardly from a forward portion, said upper and lower portions extending across the rear members, being mounted thereto.

16. An apparatus as recited in claim 10 wherein said base includes a bottom surface with roller means mounted thereto to facilitate rolling of the apparatus relative to a supporting surface positioned therebelow.

17. An apparatus as recited in claim 10 wherein a caster is positioned at a peripheral end of each said arm to facilitate rolling of the apparatus across a supporting surface.

18. An apparatus for storing and facilitating the pouring of liquid from a container comprising:

a base;

a height adjustable stem, extending upwardly from the base to a stem upper end portion;

a carrying frame defining a carrying space therewithin, the carrying space sized and shaped to hold a liquid container, said carrying frame pivotally mounted to the stem upper end portion, pivotal about a pivot axis from an upright position to a tilted dispensing position; and wherein said base is a rectangular block secured to the stem.

* * * * *